US009970459B2

(12) United States Patent
Miyamoto

(10) Patent No.: US 9,970,459 B2
(45) Date of Patent: May 15, 2018

(54) VACUUM PUMP CONNECTING APPARATUS AND METHOD FOR INSTALLING VACUUM PUMP CONNECTING APPARATUS

(71) Applicant: EBARA CORPORATION, Tokyo (JP)

(72) Inventor: Matsutaro Miyamoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 776 days.

(21) Appl. No.: 14/228,404

(22) Filed: Mar. 28, 2014

(65) Prior Publication Data

US 2014/0291980 A1 Oct. 2, 2014

(30) Foreign Application Priority Data

Mar. 29, 2013 (JP) ..... 2013-072410

(51) Int. Cl.
*F04D 19/04* (2006.01)
*F04D 29/60* (2006.01)

(52) U.S. Cl.
CPC ..... *F04D 29/605* (2013.01); *F04D 19/042* (2013.01); *Y10T 29/49826* (2015.01)

(58) Field of Classification Search
CPC ..... F16L 27/11
See application file for complete search history.

(56) References Cited

U.S. PATENT DOCUMENTS 4,524,261 A * 6/1985 Petric ..... B82Y 10/00
6,323,494 B1 * 11/2001 Lee ..... F15B 15/088 137/85
6,897,939 B2 * 5/2005 Hara ..... G03F 7/709 355/53
6,940,582 B1 * 9/2005 Tanaka ..... G03F 7/70225 355/53
7,199,373 B2 * 4/2007 Stengl ..... B82Y 10/00
8,399,851 B2 * 3/2013 Ruffell ..... H01J 37/1474
8,794,610 B2 * 8/2014 Sakai ..... G01B 5/008 269/55

FOREIGN PATENT DOCUMENTS

JP H04-031675 A 2/1992
JP H04-147548 A 5/1992
(Continued)

*Primary Examiner* — David E Bochna
(74) *Attorney, Agent, or Firm* — Pearne & Gordon LLP

(57) ABSTRACT

A vacuum pump connecting apparatus has a first vibration absorbing portion and a second vibration absorbing portion which are connected to an evacuation connection portion so as to dispose the first and second vibration absorbing portions opposite each other via the evacuation connection portion. A first end of the first vibration absorbing portion is connected to the evacuation connection portion and a second end of the first vibration absorbing assembly opposite to the second end is connected to an intake port of a vacuum pump. The first vibration absorbing portion and the second vibration absorbing portion are elastic bellows. A first end of the second vibration absorbing portion is connected to the evacuation connection portion. The vacuum pump connecting apparatus has a rigid coupling member which is connected to a second end of the second vibration absorbing portion opposite to the first end of the second vibration absorbing portion.

15 Claims, 7 Drawing Sheets

(56) References Cited

FOREIGN PATENT DOCUMENTS

| | | | | | |
|---|---|---|---|---|---|
| JP | H08-329874 | A | | 12/1996 | |
| JP | 2002-303294 | A | | 10/2002 | |
| JP | 2003-282423 | A | | 10/2003 | |
| JP | 2007-165232 | A | | 6/2007 | |
| JP | 2008-232029 | A | | 10/2008 | |
| JP | 2012-112255 | A | | 6/2012 | |
| WO | WO 2014125634 | A1 | * | 8/2014 | ..... F16L 27/11 |

* cited by examiner

VACUUM PUMP CONNECTING APPARATUS AND METHOD FOR INSTALLING VACUUM PUMP CONNECTING APPARATUS

CROSS REFERENCE TO RELATED APPLICATION

This application claims priority to Japanese Patent Application No. 2013-072410 filed Mar. 29, 2013, the entire contents of which are hereby incorporated by reference.

BACKGROUND OF THE INVENTION

Technical Field

The present invention relates to an apparatus and method for attaching a vacuum pump to a lens barrel portion of an electron beam application apparatus such as an electron beam inspection apparatus or an electron beam lithography system which uses an electron beam.

Background Art

In an electron beam application apparatus such as an electron beam inspection apparatus or an electron beam lithography system which uses an electron beam, a main chamber incorporates a stage that holds and moves a sample such as a wafer or a mask with respect to the electron beam, and the chamber is kept in vacuum in order to ensure stability and linear stability of the electron beam. In addition, the adverse effect of magnetism needs to be minimized, and thus, a magnetic material or the like is utilized to shield (seal) the magnetism outside the main chamber from affecting the inside of the main chamber.

For a lens barrel portion installed on top of the main chamber, the cylinder itself of the lens barrel portion is also formed of a magnetic material. In addition, the lens barrel portion connects to a vacuum pump such as a turbomolecular pump which can evacuate and place the lens barrel portion in a high vacuum.

When the lens barrel portion is evacuated and placed in a high vacuum using the vacuum pump, the following conditions need to be met.

(1) For the evacuation, with evacuation resistance between an evacuation target area (the inside of the lens barrel portion) and a vacuum pump intake port taken into account, the original evacuation performance of the pump needs to be fully delivered by maximizing a conductance corresponding to the inverse of the evacuation resistance.

(2) For the turbomolecular pump, a magnetic bearing utilizing an electromagnet is often adopted which supports rotation of a rotor without creating friction and which is suitable for high speed rotations. Furthermore, the turbomolecular pump includes a motor to rotationally drive the rotor. Thus, during operation of the pump, a magnetic field is generated by the magnetic bearing and the motor. Full consideration is needed for a configuration in which the pump is installed with respect to the lens barrel portion that is particularly desirably prevented from being affected by magnetism.

(3) In order to be prevented from being affected by vibration, which may affect performance and functions, the lens barrel portion is placed on a vibration damping apparatus (vibration damping base) along with the main chamber to reduce vibration transmitted from a floor on which the lens barrel portion is installed. The vertical and horizontal positions of the vibration damping apparatus during operation (while the electron beam application apparatus is rising) differ slightly from the vertical and horizontal positions of the vibration damping apparatus during non-operation (while the electron beam application apparatus is seated). Furthermore, the rotor of the turbomolecular pump rotates at high speed, and thus, the adverse effect, on the lens barrel portion, of vibration generated by the turbomolecular pump can desirably be maximally eliminated. Therefore, the lens barrel portion needs to be elastically connected to the vacuum pump such as the turbomolecular pump.

On the other hand, the turbomolecular pump is a high-speed rotating machine, and thus, if abnormality such as rotor lock or rotor destruction occurs during operation, an excessive force acts not only on the pump itself but also on, for example, an attached portion of the pump. Then, if, for example, a fixed portion of the pump has an insufficient strength, the pump may slip off. This may damage surrounding apparatuses. Moreover, a magnetic-bearing turbomolecular pump is characterized by being susceptible to external vibration with a low frequency. Thus, the turbomolecular pump needs to be mounted on a structure with a sufficient rigidity so as to maintain a sufficient strength.

Therefore, the lens barrel portion and the intake port of the vacuum pump need to be elastically connected together, and the fixed portion of the vacuum pump needs to be mounted on a fixation side such as the floor so as to ensure sufficient rigidity.

When an upper area of the lens barrel portion is to be evacuated, a related technique uses a configuration (hereinafter referred to as a "configuration A") in which the lens barrel portion is connected to the intake port via a bellows to insulate vibration and in which the vacuum pump is suspended by the bellows. For example, both Japanese Patent Laid-Open No. 2012-112255 and Japanese Patent Laid-Open No. 2008-232029 disclose the configuration A in which the turbomolecular pump is suspended from an electron beam application apparatus via the bellows.

The configuration A will be described below with reference to FIG. 6. In an electron beam application apparatus 10, an electron beam is constricted inside a lens barrel portion 12. The constricted electron beam is delivered to a sample disposed in a main chamber 14. The lens barrel portion 12 is kept in a high vacuum by a vacuum pump 16. Furthermore, the main chamber 14 is also kept in a high vacuum by another vacuum pump (not shown in the drawings). A sample stage that moves the sample is mounted in the main chamber 14. The main chamber 14 is mounted on a vibration damping base 18 that is disposed on a floor 20 serving as a base. Thus, the vibration damping base 18 dampens floor vibration or air vibration transmitted to the main chamber 14.

When the vacuum pump 16 is operated during operation of the electron beam application apparatus 10, vibration may occur, which may reduce the accuracy of inspection, lithography, or the like which is performed by the electron beam application apparatus 10. Thus, an evacuation connection portion 22 and a vibration absorbing portion 24 connected to the evacuation connection portion 22 are provided between the lens barrel portion 12 and the vacuum pump 16. The vibration absorbing portion 24 is a bellows or the like which is a coupling member with a low rigidity (elasticity). Vibration is isolated via the vibration absorbing portion 24. The vibration absorbing portion 24 is connected to the evacuation connection portion 22 and the vacuum pump 16 by flanges 26 provided at the respective opposite ends of the vibration absorbing portion 24. The vacuum pump 16 is connected to the vibration absorbing portion 24 by an intake port 28 of the vacuum pump 16.

Japanese Patent Laid-Open No. 2002-303294 discloses, in FIG. 2 thereof, the configuration A in which the turbomolecular pump is suspended from the electron beam application apparatus via the bellows. The turbomolecular pump is fixed to the floor via a spring hanging downward from a bottom portion of the pump. That is, the top and bottom of the vacuum pump are elastically fixed.

On the other hand, when a lower area of the lens barrel portion is to be evacuated, a configuration (hereinafter referred to as a "configuration B") is used in which the bellows and the pump are held in a horizontal direction, with the bellows connected to the electron beam application apparatus.

The configuration B will be described below with reference to FIG. 7. The same components are hereinafter denoted by the same reference numerals. In an electron beam application apparatus 29, an electron beam is constricted inside a lens barrel portion 12A. The constricted electron beam is then delivered to a sample disposed in the main chamber 14. The lens barrel portion 12 is kept in a high vacuum by a vacuum pump 16A.

When the vacuum pump 16A is operated during operation of the electron beam application apparatus 29, vibration may occur, which may reduce the accuracy of inspection performed by the electron beam application apparatus 29. Thus, the vibration absorbing portion 24 is provided between the lens barrel portion 12A and the vacuum pump 16A. The vibration absorbing portion 24 is connected to the lens barrel portion 12A and the vacuum pump 16A by the flanges 26 provided at the respective opposite ends of the vibration absorbing portion 24. The vacuum pump 16A is connected to the vibration absorbing portion 24 by the intake port 28 and fixed to a vacuum pump fixing structure 30. The vacuum pump fixing structure 30 is fixed to the floor 20.

For example, Japanese Patent Laid-Open No. 2003-282423 is an example in which the main chamber located below the lens barrel portion is evacuated. Japanese Patent Laid-Open No. 2003-282423 discloses, in FIG. 8 thereof, an example in which the vacuum pump is connected to the electron beam application apparatus via a bellows 40A.

Japanese Patent Laid-Open No. HEI 08-329874 discloses that the vacuum pump is fixed to a lower surface of the electron beam application apparatus. However, Japanese Patent Laid-Open No. HEI 08-329874 fails to disclose where the bellows is disposed.

In the configuration A according to the related technique, the fixing strength of the pump is disadvantageously insufficient during rotor lock and the like. Moreover, disadvantageously, the magnetic-bearing turbomolecular pump is susceptible to external vibration with a low frequency, and the configuration A in which the magnetic-bearing turbomolecular pump is less rigidly suspended offers low resistance to external vibration. In the configuration B according to the related technique, the bellows extends and contracts between a state in which the bellows is internally in vacuum and a state in which the bellows is internally at the atmospheric pressure. Thus, disadvantageously, an external force is applied to the lens barrel portion placed on the vibration damping apparatus.

SUMMARY OF INVENTION

An object of the present invention is to provide a method for attaching a vacuum pump to a lens barrel portion of an electron beam application apparatus such as an electron beam inspection apparatus or an electron beam lithography system which uses an electron beam, the method solving at least one of the problems described above in (1) to (3) and the problems of the configurations A and B according to the related techniques.

The above-described problems will be more specifically described. The distance between the lens barrel portion and the pump intake port needs to be increased in order to reduce the adverse effect of magnetism generated by the vacuum pump as described in (2) and the adverse effect of the vibration described in (3). In this case, the conductance described in (1) decreases to preclude the performance of the vacuum pump from being fully delivered.

The configuration A according to the related technique is effective for isolating vibration. However, the vacuum pump is suspended by the bellows with low rigidity, and thus, the needed attachment strength fails to be obtained when the pump abnormality described in (3) occurs, leading to a dangerous situation. Moreover, the magnetic-bearing turbomolecular pump is susceptible to external vibration with a low frequency, and the configuration A in which the magnetic-bearing turbomolecular pump is less rigidly suspended offers low resistance to external vibration.

Furthermore, in the configuration A, since the vacuum pump is suspended, an area of the lens barrel portion which can be evacuated is limited to the upper part of the lens barrel portion. Hence, a lower part of the lens barrel portion fails to be evacuated or the distance between the pump intake port and the lower part of the lens barrel portion to be evacuated increases, precluding the evacuation performance of the pump from being fully delivered.

The configuration B according to the related technique allows the vacuum pump to be located somewhat closer to the lens barrel portion and enables a certain level of increase in the conductance described in (1). However, the configuration B poses the following problems.

In the turbomolecular pump, the rotor is formed by a bell-shaped impeller and a shaft with a magnetic bearing and a motor rotor. In this case, the impeller is commonly formed of an aluminum alloy with a high specific strength. The aluminum alloy is a non-magnetic material and thus fails to be effective for shielding lines of magnetic force resulting from a strong magnetic field generated by the magnetic bearing or the motor. On the other hand, a material for a pump casing covering the entire pump is a stainless alloy that has relatively high strength and ductility. A martensite stainless steel that is a magnetic material is commonly used in order to also allow a magnetic shielding effect to be produced.

Thus, in the configuration B in which the intake port of the pump faces the lens barrel portion, the lens barrel portion is significantly affected by the magnetism generated by the magnetic bearing or the motor portion of the pump.

Furthermore, when an attempt is made to shield the magnetism with the intake port of the pump directed toward the lens barrel portion, an object is placed at or near the intake port of the pump. This significantly affects the original evacuation performance of the pump.

Moreover, the amounts of extension and contraction of the elastic bellows and the spring rigidity of the elastic bellows vary between the state in which the lens barrel portion and the pump are internally at the atmospheric pressure and the state in which the lens barrel portion and the pump are internally in vacuum. Hence, in both the configurations A and B, an external force is applied to the lens barrel portion, thus affecting the performance and functions of the apparatus.

To accomplish the above-described object, an aspect of the present invention provides a vacuum pump connecting apparatus including an evacuation connection portion for connecting an intake port of a vacuum pump to a lens barrel portion of an electron beam application apparatus, the vacuum pump connecting apparatus including a first vibration absorbing portion and a second vibration absorbing portion which are connected to the evacuation connection portion so as to lie opposite each other via the evacuation connection portion, the first vibration absorbing portion being connected to the intake port of the vacuum pump at a second end of the first vibration absorbing portion opposite to a first end of the first vibration absorbing portion connected to the evacuation connection portion, the first vibration absorbing portion and the second vibration absorbing portion absorbing vibration of the vacuum pump, the vacuum pump connecting apparatus further including a rigid coupling member fixed to the second vibration absorbing portion at a second end of the second vibration absorbing portion opposite to a first end of the second vibration absorbing portion connected to the evacuation connection portion, the coupling member being fixed to the first vibration absorbing portion or the intake port at the second end of the first vibration absorbing portion.

According to this aspect of the present invention, the evacuation connection portion is connected to the lens barrel portion, and the first vibration absorbing portion and the second vibration absorbing portion are provided opposite each other via the evacuation connection portion. The sides of the first and second vibration absorbing portions which are opposite to the evacuation connection portion are coupled together by the rigid coupling member. Thus, regardless of whether the lens barrel portion is internally at the atmospheric pressure or in vacuum, the sum of the amounts of extension and contraction of the first vibration absorbing portion and the second vibration absorbing portion is maintained constant. Furthermore, the vertical and horizontal elasticity (spring constant) of the first vibration absorbing portion and the second vibration absorbing portion as a whole is prevented from changing significantly. Hence, even when the atmospheric pressure is changed to vacuum, initial elastic connection conditions can be ensured.

When a plane containing a cylindrical axis of the lens barrel portion is parallel to a plane containing an axis of rotation of the rotor of the vacuum pump, the intake port of the vacuum pump is prevented from facing the lens barrel portion side. This allows minimization of the adverse effect of the magnetism generated by the vacuum pump.

Similar effects may be also produced when the cylindrical axis of the lens barrel portion is parallel to the axis of rotation of the rotor of the vacuum pump or in a configuration in which the intake port of the vacuum pump faces downward, whereas a side of the vacuum pump opposite to the intake port faces upward.

When the evacuation connection portion has a magnetic shielding member, the adverse effect of magnetism from the vacuum pump can be further reduced.

When the vacuum pump is fixed, on a side of the vacuum pump opposite to the intake port, to a structure joined to a base on which the electron beam application apparatus is installed, or when the coupling member is fixed to the structure at the second end of the first vibration absorbing portion, or when the coupling member is fixed to the structure at the second end of the second vibration absorbing portion, both the elastic connection between the lens barrel portion and the vacuum pump and the rigid fixation of the pump can be achieved.

Furthermore, to accomplish the above-described object, another aspect of the present invention provides a method for installing a vacuum pump that evacuates a lens barrel portion of an electron beam application apparatus, the method including connecting an intake port of the vacuum pump to the lens barrel portion of the electron beam application apparatus via an evacuation connection portion; connecting a first vibration absorbing portion and a second vibration absorbing portion to the evacuation connection portion so as to dispose the first vibration absorbing portion and the second vibration absorbing portion opposite each other via the evacuation connection portion, in order to absorb vibration of the vacuum pump; connecting the first vibration absorbing portion to the intake port of the vacuum pump at a second end of the first vibration absorbing portion opposite to a first end of the first vibration absorbing portion connected to the evacuation connection portion; fixing a rigid coupling member to the second vibration absorbing portion at a second end of the second vibration absorbing portion opposite to a first end of the second vibration absorbing portion connected to the evacuation connection portion; and fixing the coupling member to the first vibration absorbing portion or the intake port at the second end of the first vibration absorbing portion.

DESCRIPTION OF EMBODIMENTS

Embodiments of the present invention will be described below with reference to the drawings.

Figure 1:
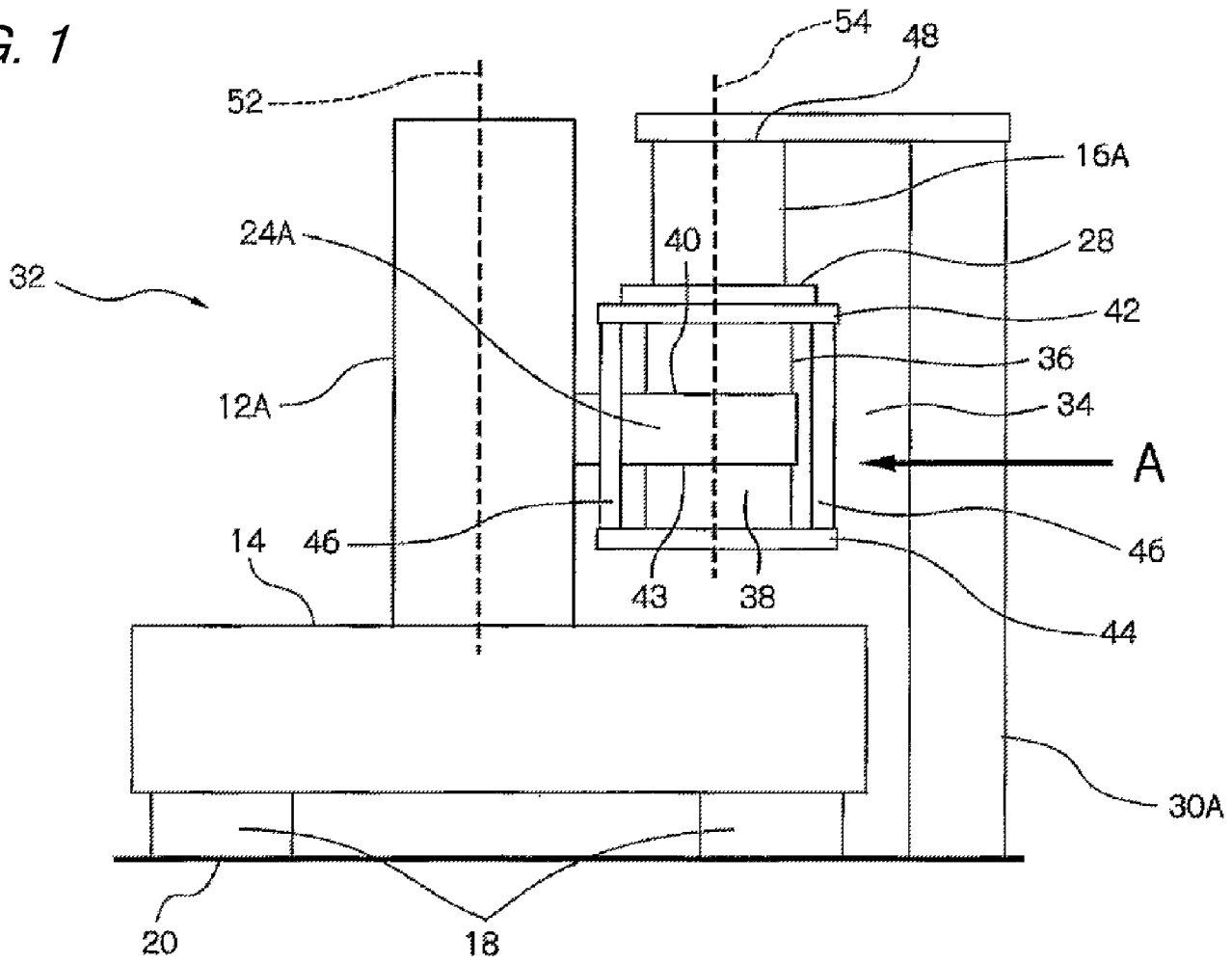
FIG. 1 is a front view of an electron beam application apparatus and a vacuum pump connecting apparatus showing an embodiment of the present invention.

FIG. 1 is a front view of an electron beam application apparatus 32 and a vacuum pump connecting apparatus 34 showing an embodiment of the present invention. A vacuum pump 16A has an intake port 28 and an exhaust port. The vacuum pump 16A sucks, through the intake port 28, a gas in a lens barrel portion 12A of the electron beam application apparatus 32 which is to be evacuated, and discharges the gas through the exhaust port. The vacuum pump connecting apparatus 34 includes an evacuation connection portion 24A that connects the intake port 28 of the vacuum pump 16A to the lens barrel portion 12A.

The vacuum pump connecting apparatus 34 has a first vibration absorbing portion 36 and a second vibration absorbing portion 38 which are connected to the evacuation connection portion 24A so that the first vibration absorbing portion 36 and the second vibration absorbing portion 38 lie opposite each other via the evacuation connection portion 24A. The first vibration absorbing portion 36 is connected to the evacuation connection portion 24A at a first end 40 of the first vibration absorbing portion 36. The first vibration absorbing portion 36 is further connected to the intake port 28 of the vacuum pump 16A at a second end 42 of the first vibration absorbing portion 36 opposite to the first end 40. The first vibration absorbing portion 36 and the second vibration absorbing portion 38 absorb vibration of the vacuum pump. According to the present embodiment, the first vibration absorbing portion 36 and the second vibration absorbing portion 38 are elastic bellows 36 and 38.

The vacuum pump connecting apparatus 34 has a first end 43 of the second vibration absorbing portion 38 connected to the evacuation connection portion 24A. The vacuum pump connecting apparatus 34 has a rigid coupling member 46. The rigid coupling member 46 is fixed to the second vibration absorbing portion 38 at a second end 44 of the second vibration absorbing portion 38 opposite to the first end 43. The coupling member 46 is fixed to the first vibration absorbing portion 36 at the second end 42 of the first vibration absorbing portion 36. The coupling member 46 may be fixed to the intake port 28.

The electron beam application apparatus 32 has a main chamber 14 on a floor 20 on which the electron beam application apparatus 32 is installed; in the main chamber 14, a stage movably holding a sample is installed. The main chamber 14 is placed via a vibration damping base 18. The vibration damping base 18 normally has three to four legs.

The evacuation connection portion 24A is attached to a side portion of the lens barrel portion 12A placed in an approximately central portion of an upper surface of the main chamber 14, and is connected to the elastic bellows 36 and 38 at the top and bottom, respectively, of the evacuation connection portion 24A. The flanges 42 and 44 of the elastic bellows 36 and 38, located opposite the vacuum container, are coupled together by a coupling member 46. According to the present embodiment, the coupling member 46 is a plurality of (three to four) flange coupling rods. In FIG. 1, the intake port 28 of the vacuum pump 16A faces downward. The vacuum pump 16A is fixed, on a side 48 thereof opposite to the intake port 28 of the vacuum pump 16A, to a structure 30A joined to a base on which the electron beam application apparatus 32 is installed, that is, the floor 20.

Figure 2:
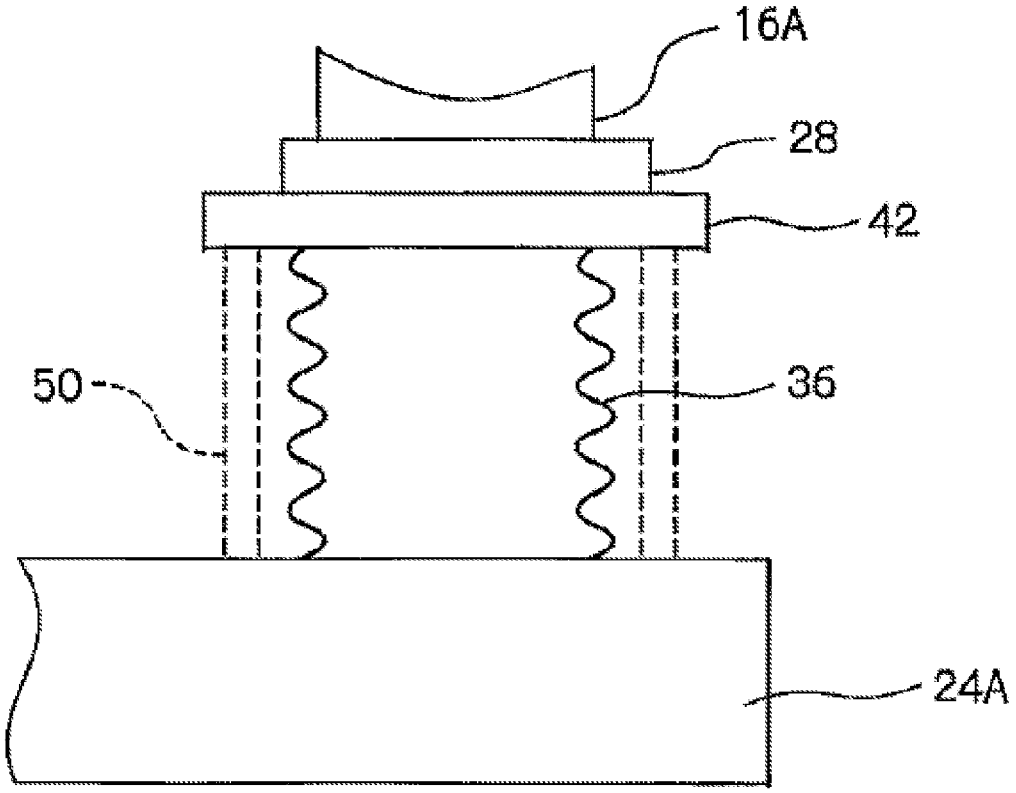
FIG. 2 is a detailed diagram of an elastic bellows 36.

According to the present embodiment, the elastic bellows 36 and 38 are formed only of stainless steel bellows. A welding bellows of stainless steel is adopted in order to reduce a spring constant. FIG. 2 is a detailed diagram of the elastic bellows 36. However, the elastic bellows 36 and 38 may include the stainless steel bellows 36 and a cylindrical rubber member 50 (shown by dotted lines in FIG. 2) surrounding the stainless steel bellows 36. Addition of the cylindrical rubber member 50 is equal to addition of a damping element and is effective, for example, for limiting contraction while the bellows is in vacuum.

The elastic bellows 36 and 36 are desirably of the same length in the vertical direction in FIG. 1. When the electron beam application apparatus is assumed to be raised by the vibration damping base during operation, the length of the structure is adjusted such that the upper and lower bellows 36 and 38 have the same length in the vertical direction at a position where the electron beam application apparatus has been raised.

The evacuation connection portion and each of the elastic bellows 36 and 38 can also be connected together by providing a flange both on the evacuation connection portion and on the bellows and connecting the flanges together. In FIG. 1, the flange is provided only on the bellows. The evacuation connection portion and each of the elastic bellows 36 and 38 can be connected together by providing a flange both on the evacuation connection portion and on the bellows or providing a flange on only one of the evacuation connection portion and the bellows. The evacuation connection portion or bellows which has no flange is shaped to correspond to the flange. The evacuation connection portion and each of the bellows 36 and 38 can also be connected together by welding or bonding. A flange may or may not be used to establish the connection between the vacuum pump and the elastic bellows 36 and the connection between the coupling member 46 and the elastic bellows 38. Without a flange, the connection is established by welding or bonding.

The rod providing the coupling member 46 may be metal or plastic as long as the rod is hard. Furthermore, the coupling member 46 may cylindrically surround the elastic bellows 36 and 38 instead of including a rod. In this case, a hole needs to be formed in a part of the coupling member 46 so that the evacuation connection portion 24A can be passed through the hole.

Figure 3:
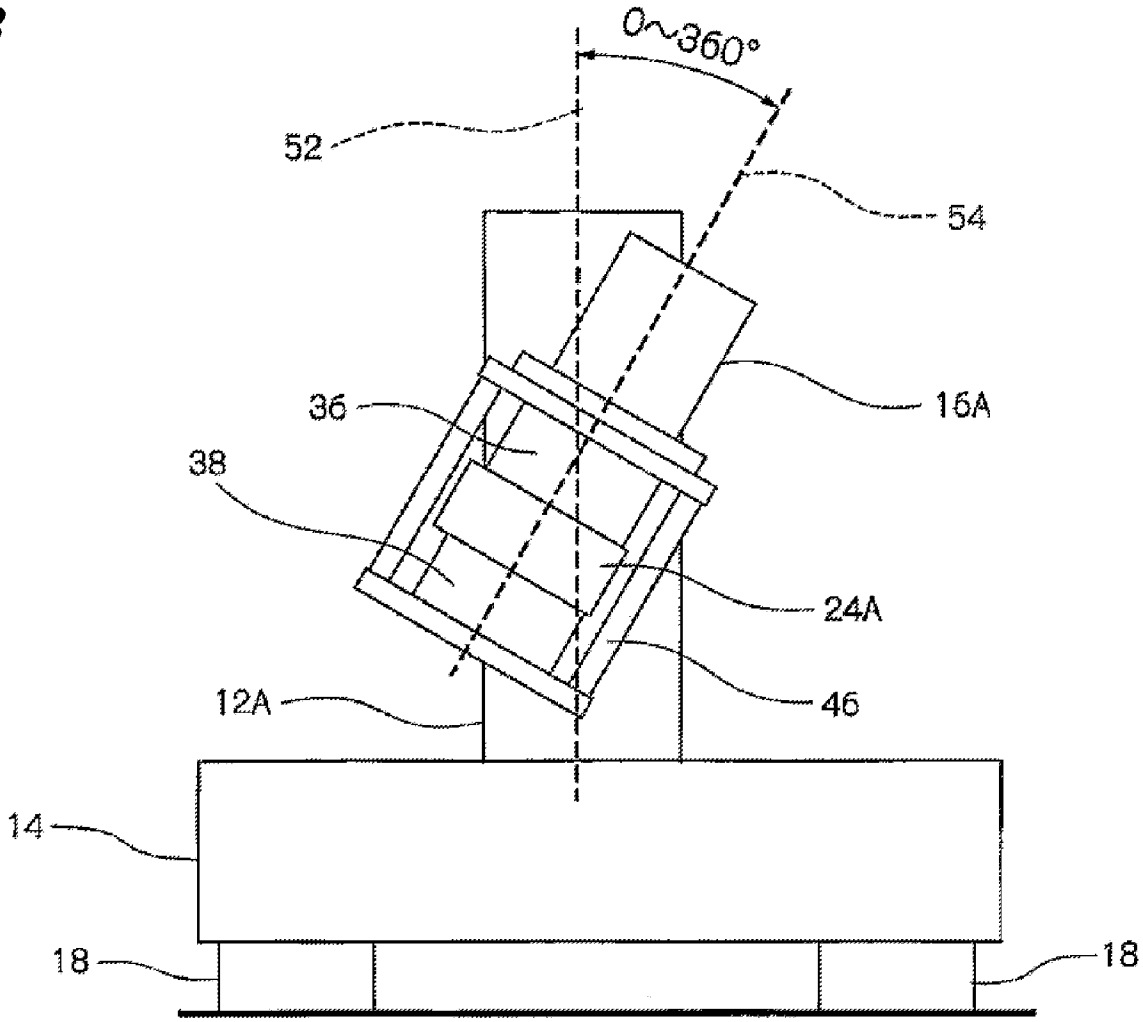
FIG. 3 is a diagram of an embodiment in which a vacuum pump according to the embodiment shown in FIG. 1 is inclined, as viewed in a direction shown by arrow A in FIG. 1.

FIG. 3 shows another embodiment of the present invention. The embodiment shown in FIG. 3 is different from the embodiment in FIG. 1 in the angle between a cylindrical axis 52 of the lens barrel portion 12A and an axis of rotation 54 of the rotor of the vacuum pump 16A. In the other aspects, the embodiment shown in FIG. 3 is the same as the embodiment in FIG. 1. FIG. 3 is a diagram of an embodiment in which the vacuum pump according to the embodiment shown in FIG. 1 is inclined, as viewed in a direction shown by arrow A in FIG. 1. The angle may be within the range from 0° to 360°.

When the cylindrical axis 52 of the lens barrel portion is parallel to the axis of rotation 54 of the rotor, the above-described angle is 0° or 180°. When the intake port of the vacuum pump faces downward and the side of the vacuum pump opposite to the intake port faces upward, the angle is 0°.

Figure 4B:
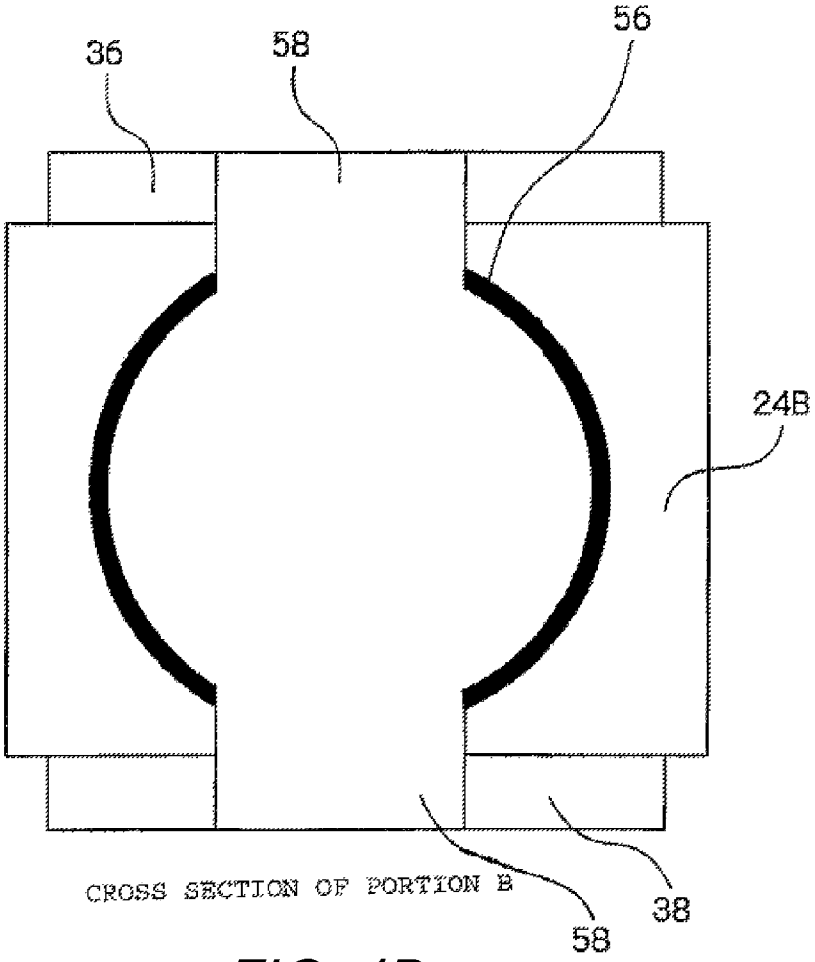
FIG. 4B is a diagram of the embodiment as viewed in a direction shown by arrow B in FIG. 4A.
Figure 4A:
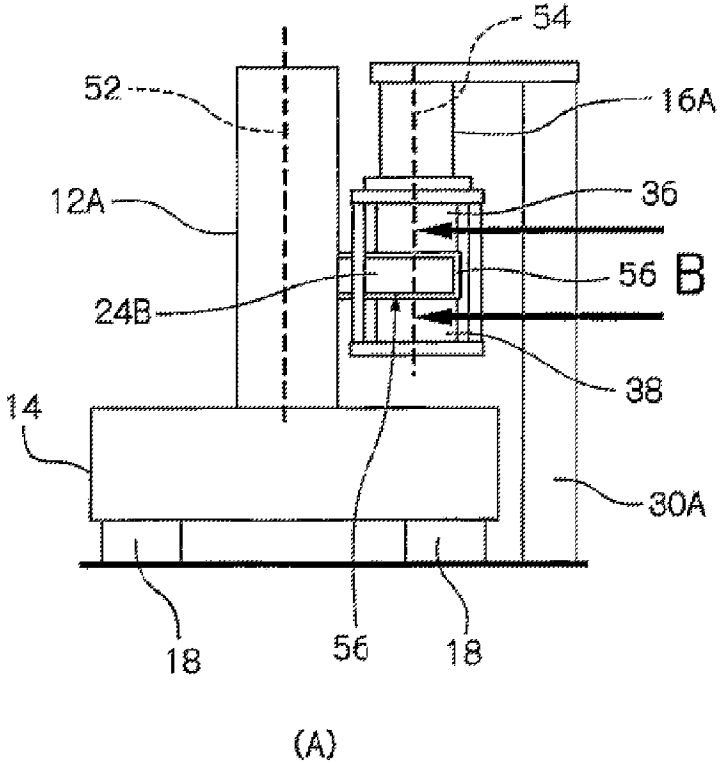
FIG. 4A is a diagram showing an embodiment in which a magnetic shielding member is provided in an evacuation connection portion according to the embodiment shown in FIG. 1.

FIGS. 4A and 4B show yet another embodiment of the present invention. FIG. 4A shows an embodiment in which a magnetic shielding member 56 is provided in the evacuation connection portion according to the embodiment shown in FIG. 1. FIG. 4B is a cross-sectional view of this embodiment as viewed in a direction shown by arrow B in FIG. 4A. FIG. 4B shows a cross section taken at the position of the axis of rotation 54 of the rotor of the vacuum pump.

The magnetic shielding member 56, formed of a magnetic material, is cylindrically disposed in an evacuation connection portion 24B. The magnetic shielding member 56 is desirably located in contact with or in proximity to a magnetic shielding portion of the lens barrel portion 12A in order to enhance the effects of the magnetic shielding member 56. The cylindrical shape can also be formed by rounding a sheet-like magnetic material. Furthermore, the cylinder may include multiple layers in order to enhance a shielding effect. The evacuation connection portion itself may be made of a magnetic material such as iron. When a hollow shape is formed using a magnetic material, in contrast to the adverse effect of a magnetic field outside the evacuation connection portion 24B, the adverse effect of a magnetic field on the inside of the evacuation connection portion 24B decreases with increasing longitudinal length of the evacuation connection portion 24B. A longer magnetic path attenuates the external magnetic field.

The cross-sectional view in FIG. 4B is taken at the position of a center line of the bellows 36 and 38. Thus, a penetration portion (cutout) 58 is formed in the evacuation connection portion 24B so that a gas can flow between the evacuation connection portion 24B and each of the bellows 36 and 38, located on top of and under the evacuation connection portion 24B, respectively.

Figure 5:
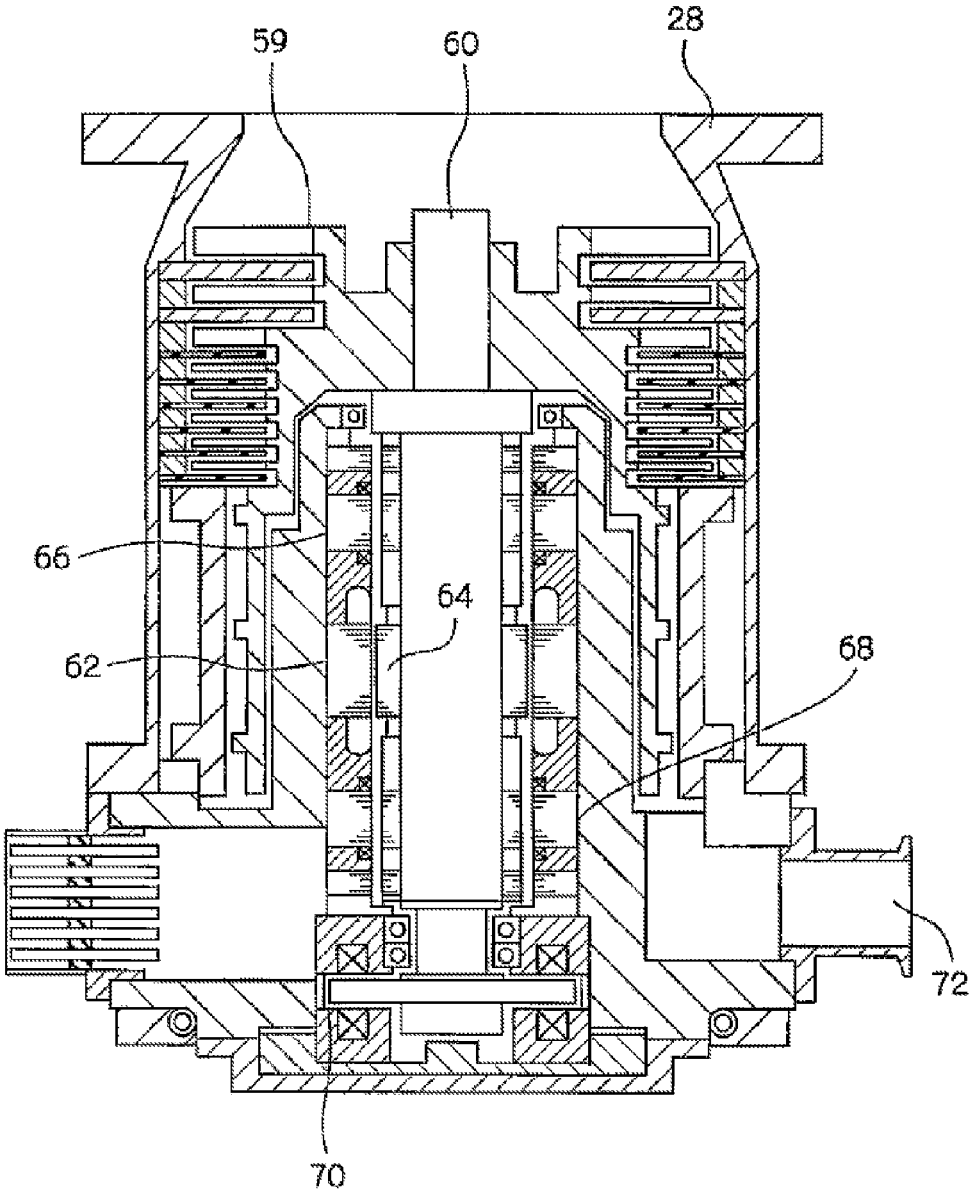
FIG. 5 is a diagram showing an internal structure of a turbomolecular pump.
Figure 6:
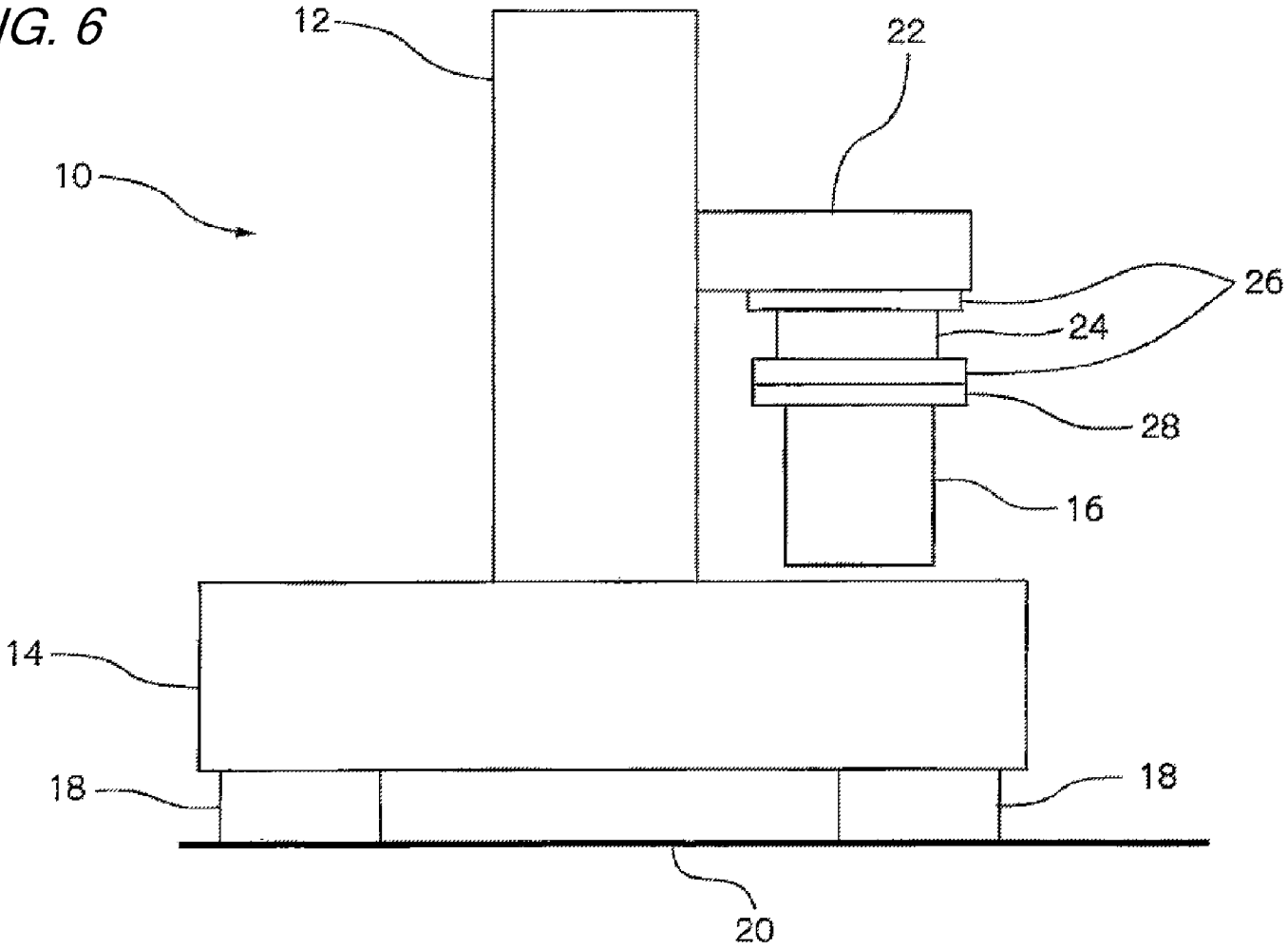
FIG. 6 is a diagram showing a configuration A according to a related technique.
Figure 7:
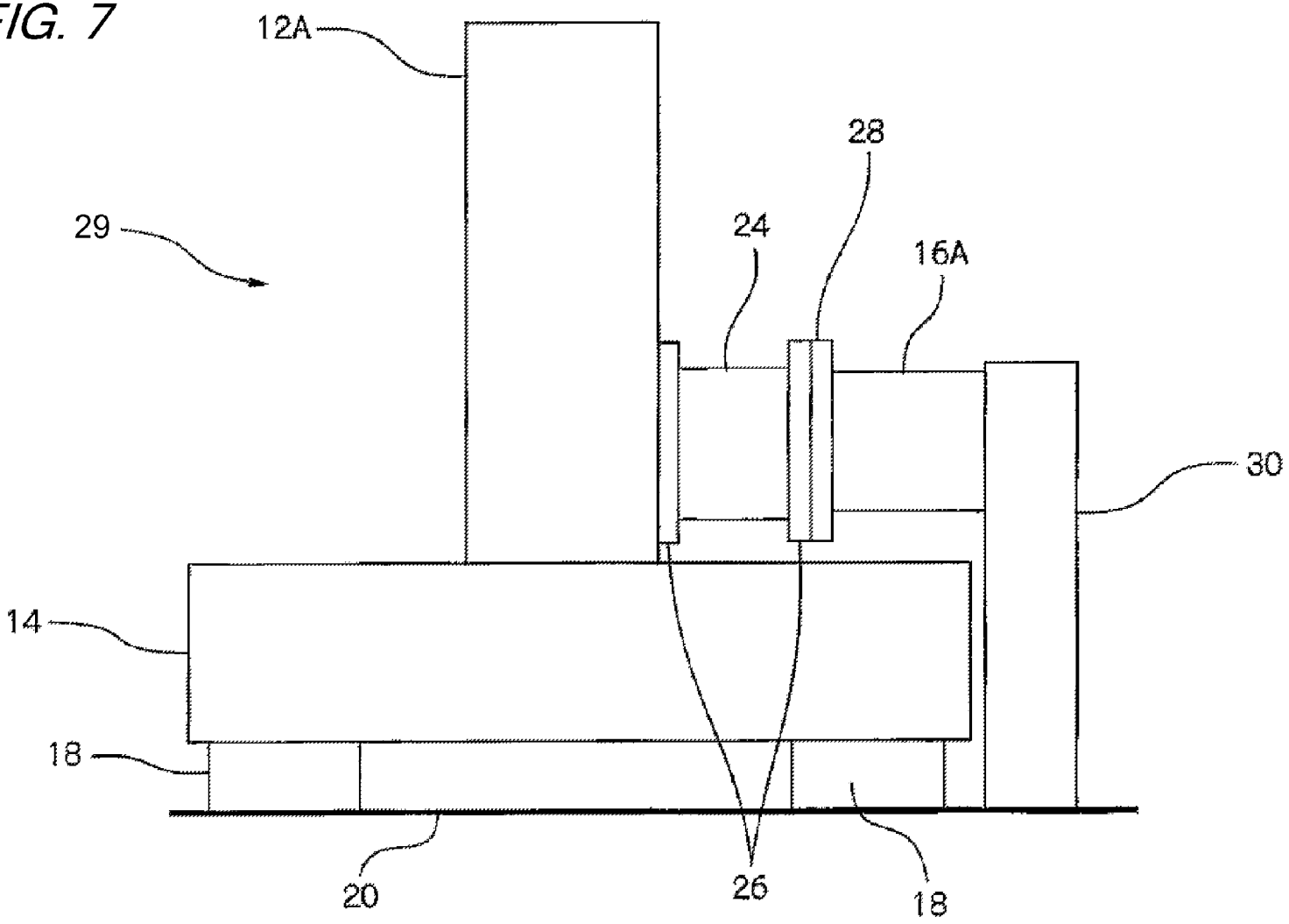
FIG. 7 is a diagram showing a configuration B according to a related technique.

FIG. 5 shows an internal structure of a turbomolecular pump that is an example of the vacuum pump. FIG. 5 is a cross-sectional view of a magnetic-bearing turbomolecular pump often used for the electron beam application apparatus. A rotor shaft 60 that rotationally drives a rotor 59 is commonly raised and supported for five-axis control by a magnetic bearing apparatus with two radial magnetic bearings and one axial magnetic bearing.

A motor rotor 64 providing a motor 62 is secured approximately to the center of the rotor shaft 60. A motor stator providing the motor 62 is disposed at a position opposite to the motor rotor 64. A rotor side radial magnetic bearing 66 and an opposite-rotor-side radial magnetic bearing 68 are provided on an upper part and a lower part, respectively, of the rotor shaft 60 across the motor 62. The rotor shaft 60 includes an axial magnetic bearing 70 disposed at an opposite-rotor-side lower end thereof. An exhaust port 72 is provided at a lower part of the vacuum pump.

As described above, the magnetic bearing and the motor are incorporated into the turbomolecular pump. The intake port 28 side covered by the rotor 59 formed of a non-magnetic material has no magnetic shielding capability. On the other hand, a component other than the intake port 28 side can be configured to exert a magnetic shielding effect by forming the casing using a magnetic material or constructing an external shielding structure using a magnetic material.

An example of the vacuum pump other than the turbomolecular pump is an ion pump which is often used as a vacuum pump for the lens barrel portion and which can create a high vacuum without vibration.

In the embodiment in FIG. 1, the evacuation connection portion according to the present invention may be connected to the lens barrel portion of the electron beam application apparatus. However, the vacuum pump connecting apparatus according to the present invention may be applied to the main chamber 14 of the electron beam application apparatus. In this case, the evacuation connection portion is connected to the main chamber 14, which is a suction target. Thus, possible vibration of the vacuum pump can be prevented from being transmitted to the main chamber 14.

In a method for installing the vacuum pump that evacuates the lens barrel portion of the electron beam application apparatus, using the connecting apparatus shown in FIG. 1, the evacuation connection portion is provided between the side portion of the lens barrel portion and the intake port of the vacuum pump, and two elastic bellows are provided so as to lie opposite each other via the evacuation connection portion. Both flanges on the respective sides of the bellows which are opposite to the evacuation connection portion are coupled together by a plurality of rods. The floor side on which the electron beam application apparatus is installed serves as a fixation side. The lens barrel portion side supported by the vibration damping base serves as a movable side.

The vacuum pump is fixed, on the side thereof opposite to the intake port, to the structure joined to the fixation side so that a plane containing the cylindrical axis of the lens barrel portion is parallel to a plane containing the axis of rotation of the rotor of the vacuum pump.

According to this installation method, the evacuation connection portion is installed on the side portion of the lens barrel portion, the two elastic bellows are provided so as to lie opposite each other via the evacuation connection portion, and both flanges on the respective sides of the bellows which are opposite to the evacuation connection portion are coupled together by the plurality of rods. Thus, regardless of whether the evacuation connection portion is internally at the atmospheric pressure or in vacuum, the sum of the amounts of extension and contraction of both elastic bellows is maintained constant. Moreover, the horizontal and vertical elasticity (spring constant) of both elastic bellows as a whole is prevented from changing significantly. Hence, even when the atmospheric pressure is changed to vacuum, elastic connection conditions which is set while the evacuation connection portion is internally at the atmospheric pressure can be maintained.

The floor side on which the electron beam application apparatus is installed serves as a fixation side, and the lens barrel portion side supported by the vibration damping apparatus serves a movable side. The vacuum pump is fixed, on the side thereof opposite to the intake port, to the structure joined to the fixation side. This allows establishment of both the elastic connection between the lens barrel portion and the vacuum pump and the rigid fixation of the pump.

Moreover, a plane containing the cylindrical axis of the lens barrel portion is parallel to a plane containing the axis of rotation of the rotor of the vacuum pump. Thus, the intake port of the vacuum pump is prevented from facing the lens barrel portion side, allowing minimization of the adverse effect of magnetism generated by the vacuum pump. Similar effects are also exerted in a configuration in which the cylindrical axis of the lens barrel portion is parallel to the axis of rotation of the rotor of the vacuum pump.

When the intake port of the vacuum pump faces downward and the side of the vacuum pump opposite to the intake port faces upward, the conductance can be set to a large value, allowing efficient evacuation of the lower portion of the lens barrel portion and rigid fixation of the pump.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A vacuum pump apparatus comprising:

a vacuum pump;

an evacuation connection portion for connecting an intake port of the vacuum pump to a lens barrel portion of an electron beam application apparatus;

a first vibration absorbing portion and a second vibration absorbing portion which are connected to the evacuation connection portion so as to lie opposite each other via the evacuation connection portion, wherein:

the first vibration absorbing portion is connected to the evacuation connection portion at a first end of the first vibration absorbing portion, the first vibration absorbing portion is connected to the intake port of the vacuum pump at a second end of the first vibration absorbing portion opposite to the first end, the second vibration absorbing portion is connected to the evacuation connection portion at a first end of the second vibration absorbing portion, and the first vibration absorbing portion and the second vibration absorbing portion are configured to absorb vibration of the vacuum pump; and a rigid coupling member fixed to the second vibration absorbing portion at a second end of the second vibration absorbing portion opposite to the first end, the rigid coupling member being fixed to the first vibration absorbing portion or the intake port of the vacuum pump, wherein the evacuation connection portion comprises a magnetic shielding member, wherein the vacuum pump apparatus further comprises the electron beam application apparatus, and wherein a plane containing a cylindrical axis of the lens barrel portion is parallel to a plane containing an axis of rotation of a rotor of the vacuum pump.

2. A method of installing the vacuum pump connecting apparatus according to claim 1, the method comprising:

connecting the intake port of the vacuum pump to the lens barrel portion of the electron beam application apparatus via the evacuation connection portion;

connecting the first vibration absorbing portion and the second vibration absorbing portion to the evacuation connection portion so as to lie opposite each other via the evacuation connection portion;

connecting the first end of the first vibration absorbing portion to the evacuation connection portion at the first end of the first vibration absorbing portion;

connecting the second end of the first vibration absorbing portion to the intake port of the vacuum pump;

connecting the first end of the second vibration absorbing portion to the evacuation connection portion;

fixing the rigid coupling member to the second vibration absorbing portion at the second end of the second vibration absorbing portion opposite to the first end;

fixing the rigid coupling member to the first vibration absorbing portion or the intake port of the vacuum pump; and disposing the plane containing the cylindrical axis of the lens barrel portion parallel to the plane containing the axis of rotation of the rotor of the vacuum pump.

3. The method according to claim 2, further comprising disposing the intake port of the vacuum pump in such a manner that the intake port faces a first direction and disposing a side of the vacuum pump opposite to the intake port in such a manner that the side faces a second direction opposite to the first direction.

4. The method according to claim 2, further comprising fixing the vacuum pump, on a side of the vacuum pump opposite to the intake port, to a structure joined to a base on which the electron beam application apparatus is installed, or fixing the rigid coupling member to the structure at the second end of the first vibration absorbing portion, or fixing the rigid coupling member to the structure at the second end of the second vibration absorbing portion.

5. A vacuum pump apparatus comprising:

a vacuum pump;

an evacuation connection portion for connecting an intake port of the vacuum pump to a lens barrel portion of an electron beam application apparatus;

a first vibration absorbing portion and a second vibration absorbing portion which are connected to the evacuation connection portion so as to lie opposite each other via the evacuation connection portion, wherein:

the first vibration absorbing portion is connected to the evacuation connection portion at a first end of the first vibration absorbing portion, the first vibration absorbing portion is connected to the intake port of the vacuum pump at a second end of the first vibration absorbing portion opposite to the first end, the second vibration absorbing portion is connected to the evacuation connection portion at a first end of the second vibration absorbing portion, and the first vibration absorbing portion and the second vibration absorbing portion are configured to absorb vibration of the vacuum pump; and a rigid coupling member fixed to the second vibration absorbing portion at a second end of the second vibration absorbing portion opposite to the first end, the rigid coupling member being fixed to the first vibration absorbing portion or the intake port of the vacuum pump, wherein the evacuation connection portion comprises a magnetic shielding member, wherein the vacuum pump apparatus further comprises the electron beam application apparatus, and wherein a cylindrical axis of the lens barrel portion is parallel to an axis of rotation of a rotor of the vacuum pump.

6. A method of installing the vacuum pump connecting apparatus according to claim 5, the method comprising:

connecting the intake port of the vacuum pump to the lens barrel portion of the electron beam application apparatus via the evacuation connection portion;

connecting the first vibration absorbing portion and the second vibration absorbing portion to the evacuation connection portion so as to lie opposite each other via the evacuation connection portion;

connecting the first end of the first vibration absorbing portion to the evacuation connection portion at the first end of the first vibration absorbing portion;

connecting the second end of the first vibration absorbing portion to the intake port of the vacuum pump;

connecting the first end of the second vibration absorbing portion to the evacuation connection portion;

fixing the rigid coupling member to the second vibration absorbing portion at the second end of the second vibration absorbing portion opposite to the first end;

fixing the rigid coupling member to the first vibration absorbing portion or the intake port of the vacuum pump; and disposing the cylindrical axis of the lens barrel portion parallel to the axis of rotation of the rotor of the vacuum pump.

7. The method according to claim 6, further comprising disposing the intake port of the vacuum pump in such a manner that the intake port faces a first direction and disposing a side of the vacuum pump opposite to the intake port in such a manner that the side faces a second direction opposite to the first direction.

8. The method according to claim 6, further comprising fixing the vacuum pump, on a side of the vacuum pump opposite to the intake port, to a structure joined to a base on which the electron beam application apparatus is installed, or fixing the rigid coupling member to the structure at the second end of the first vibration absorbing portion, or fixing the rigid coupling member to the structure at the second end of the second vibration absorbing portion.

9. A vacuum pump apparatus comprising:

a vacuum pump;

an evacuation connection portion for connecting an intake port of the vacuum pump to a lens barrel portion of an electron beam application apparatus;

a first vibration absorbing portion and a second vibration absorbing portion which are connected to the evacuation connection portion so as to lie opposite each other via the evacuation connection portion, wherein:

the first vibration absorbing portion is connected to the evacuation connection portion at a first end of the first vibration absorbing portion, the first vibration absorbing portion is connected to the intake port of the vacuum pump at a second end of the first vibration absorbing portion opposite to the first end, the second vibration absorbing portion is connected to the evacuation connection portion at a first end of the second vibration absorbing portion, and the first vibration absorbing portion and the second vibration absorbing portion are configured to absorb vibration of the vacuum pump; and a rigid coupling member fixed to the second vibration absorbing portion at a second end of the second vibration absorbing portion opposite to the first end, the rigid coupling member being fixed to the first vibration absorbing portion or the intake port of the vacuum pump, wherein the evacuation connection portion comprises a magnetic shielding member, and wherein the intake port of the vacuum pump faces a first direction and a side of the vacuum pump opposite to the intake port faces a second direction opposite to the first direction.

10. A method of installing the vacuum pump connecting apparatus according to claim 6, the method comprising:

connecting the intake port of the vacuum pump to the lens barrel portion of the electron beam application apparatus via the evacuation connection portion;

connecting the first vibration absorbing portion and the second vibration absorbing portion to the evacuation connection portion so as to lie opposite each other via the evacuation connection portion;

connecting the first end of the first vibration absorbing portion to the evacuation connection portion at the first end of the first vibration absorbing portion;

connecting the second end of the first vibration absorbing portion to the intake port of the vacuum pump;

connecting the first end of the second vibration absorbing portion to the evacuation connection portion;

fixing the rigid coupling member to the second vibration absorbing portion at the second end of the second vibration absorbing portion opposite to the first end;

fixing the rigid coupling member to the first vibration absorbing portion or the intake port of the vacuum pump; and disposing the intake port of the vacuum pump in such a manner that the intake port faces a first direction and disposing a side of the vacuum pump opposite to the intake port in such a manner that the side faces a second direction opposite to the first direction.

11. The method according to claim 10, further comprising fixing the vacuum pump, on a side of the vacuum pump opposite to the intake port, to a structure joined to a base on which the electron beam application apparatus is installed, or fixing the rigid coupling member to the structure at the second end of the first vibration absorbing portion, or fixing the rigid coupling member to the structure at the second end of the second vibration absorbing portion.

12. A vacuum pump apparatus comprising:

a vacuum pump;

an evacuation connection portion for connecting an intake port of the vacuum pump to a lens barrel portion of an electron beam application apparatus;

a first vibration absorbing portion and a second vibration absorbing portion which are connected to the evacuation connection portion so as to lie opposite each other via the evacuation connection portion, wherein:

the first vibration absorbing portion is connected to the evacuation connection portion at a first end of the first vibration absorbing portion, the first vibration absorbing portion is connected to the intake port of the vacuum pump at a second end of the first vibration absorbing portion opposite to the first end, the second vibration absorbing portion is connected to the evacuation connection portion at a first end of the second vibration absorbing portion, and the first vibration absorbing portion and the second vibration absorbing portion are configured to absorb vibration of the vacuum pump; and a rigid coupling member fixed to the second vibration absorbing portion at a second end of the second vibration absorbing portion opposite to the first end, the rigid coupling member being fixed to the first vibration absorbing portion or the intake port of the vacuum pump, wherein the evacuation connection portion comprises a magnetic shielding member wherein the vacuum pump apparatus further comprises the electron beam application apparatus, and wherein the vacuum pump is fixed, on a side of the vacuum pump opposite to the intake port, to a structure joined to a base on which the electron beam application apparatus is installed, or the rigid coupling member is fixed to the structure at the second end of the first vibration absorbing portion, or the rigid coupling member is fixed to the structure at the second end of the second vibration absorbing portion.

13. The vacuum pump apparatus according to claim 12, wherein the vacuum pump is fixed, on the side of the vacuum pump opposite to the intake port, to the structure joined to the base on which the electron beam application apparatus is installed.

14. The vacuum pump apparatus according to claim 12, wherein the rigid coupling member is fixed to the structure at the second end of the first vibration absorbing portion.

15. A method of installing the vacuum pump connecting apparatus according to claim 12, the method comprising:

connecting the intake port of the vacuum pump to the lens barrel portion of the electron beam application apparatus via the evacuation connection portion;

connecting the first vibration absorbing portion and the second vibration absorbing portion to the evacuation connection portion so as to lie opposite each other via the evacuation connection portion;

connecting the first end of the first vibration absorbing portion to the evacuation connection portion at the first end of the first vibration absorbing portion;

connecting the second end of the first vibration absorbing portion to the intake port of the vacuum pump;

connecting the first end of the second vibration absorbing portion to the evacuation connection portion;

fixing the rigid coupling member to the second vibration absorbing portion at the second end of the second vibration absorbing portion opposite to the first end;

fixing the rigid coupling member to the first vibration absorbing portion or the intake port of the vacuum pump; and fixing the vacuum pump, on a side of the vacuum pump opposite to the intake port, to a structure joined to a base on which the electron beam application apparatus is installed, or fixing the rigid coupling member to the structure at the second end of the first vibration absorbing portion, or fixing the rigid coupling member to the structure at the second end of the second vibration absorbing portion.

* * * * *